US005664732A

United States Patent [19]

Smolen, Jr. et al.

[11] Patent Number: 5,664,732

[45] Date of Patent: Sep. 9, 1997

[54] NOZZLE FOR PUMP DISPENSERS

[75] Inventors: Richard J. Smolen, Jr., Algonquin, Ill.; William Contaxis, III, Perrysburg, Ohio

[73] Assignee: Owens-Illinois Closure Inc., Toledo, Ohio

[21] Appl. No.: 515,881

[22] Filed: Aug. 16, 1995

[51] Int. Cl.[6] ..... B05B 1/28; B05B 1/34; B05B 9/043

[52] U.S. Cl. ..... 239/121; 239/333; 239/394; 239/478; 239/526

[58] Field of Search ..... 239/390, 391, 239/393, 394, 594, 120, 121, 333, 526, 399, 463

[56] References Cited

U.S. PATENT DOCUMENTS

| | | | |
|---|---|---|---|
| 2,172,193 | 9/1939 | Downs | 239/597 |
| 3,054,563 | 9/1962 | Steinan | 239/597 |
| 3,398,899 | 8/1968 | Fry | 239/597 |
| 3,711,029 | 1/1973 | Bartlett | 239/394 |
| 4,109,869 | 8/1978 | Brockelby et al. | 239/333 |
| 4,730,775 | 3/1988 | Maas | 239/120 |
| 5,222,637 | 6/1993 | Giuffredi | 239/333 |

FOREIGN PATENT DOCUMENTS

| | | | |
|---|---|---|---|
| 2441369 | 3/1975 | Germany | 239/139 |
| 284868 | 10/1992 | Japan | 231/120 |
| 322759 | 11/1992 | Japan | 239/120 |

*Primary Examiner*—Kevin Weldon

[57] ABSTRACT

A pump dispenser has a nozzle body on which is rotatably disposed a nozzle cap having two orifices which selectively align with a swirl chamber formed in the front end of the body. One orifice is formed with a surrounding cup-like structure to retain the last drop of liquid after discharge. The other is formed with a pair of diagonal parallel ribs on opposite sides of the orifice to effect an elongated narrow landing pattern for the spray.

8 Claims, 4 Drawing Sheets

NOZZLE FOR PUMP DISPENSERS

BACKGROUND OF THE INVENTION

This invention relates to a nozzle for a hand-held pump dispenser or the like. More specifically, it relates to a nozzle having a rotatable nozzle cap by which a selected orifice in the cap can be aligned with a swirl chamber mechanical breakup formed in the nozzle body to produce a desired form of discharge. The invention also relates to specific orifice shapes which may produce a conical spray pattern or a fan-type spray having narrow elongated spray landing pattern. The inventor also contemplates anti-drip means for discharge orifices.

The prior art is replete with a large number of nozzle structures adaptable for use with a hand-held pump dispensers. Many of these, such as the McKinney U.S. Pat. No. 4,227,650 issued Oct. 14, 1980 and U.S. Pat. No. 4,161,288 issued Jul. 17, 1979 disclose cooperative means within the nozzle for forming an axial swirl chamber. The art also includes patents in which, by rotating the nozzle cap, the discharge may selectively be a spray cone or a stream. Examples are the Micallef U.S. Pat. No. 3,843,030 which issued Oct. 22, 1974 and the Hayes U.S. Pat. No. 4,247,048 issued Jan. 27, 1981. These patents are of interest for their showing of a single offset opening in the rotatable cap to line up selectively with a swirl chamber mechanical breakup or an open channel so that the resulting discharge is a conical spray or a stream selectively.

It is also noted from the art that attempts have been made in the past to effect a spray having a narrow elongated landing pattern, a so-called fan spray. An example is disclosed in the Grogan U.S. Pat. No. 4,174,069 issued Nov. 13, 1979. To do this, on the outlet from the swirl chamber a pair of radially inward projections are formed. These projections cause a conical spray to break up and to form a substantially flat fan spray segment.

There has been a need for a pump dispenser having the ability to emit respectively spray discharges in the form of a cone spray or a fan spray. There has also been a need for means in the discharge of a dispenser for retaining the last drop emitted from the discharge orifice after completion of use.

There has also been a need for a spray dispenser in which the discharge is modified by means external of the orifice to produce a fan-type spray.

SUMMARY OF THE INVENTION

The invention, therefore, comprises for a pump dispenser a nozzle body on which is rotatably disposed a nozzle cap having two orifices which selectively align with a swirl chamber formed in the body. The cap is formed about the orifices respectively with means to modify the spray discharge. Further, the invention may be thought of as a discharge orifice formed with a surrounding cup-like structure to retain the last drop of liquid after discharge. The invention may further be thought of in terms of a discharge from a swirl chamber in which a pair of diagonal parallel ribs are formed on opposite sides of the orifice to effect an elongated narrow landing pattern for the spray.

BRIEF DESCRIPTION OF THE DRAWINGS

Other objects and features of the invention will be apparent to those skilled in the art from a study of the following specification and drawings, all of which disclose non-limiting forms of the invention. In the drawings.

DESCRIPTION OF THE PREFERRED EMBODIMENTS

Figure 1:
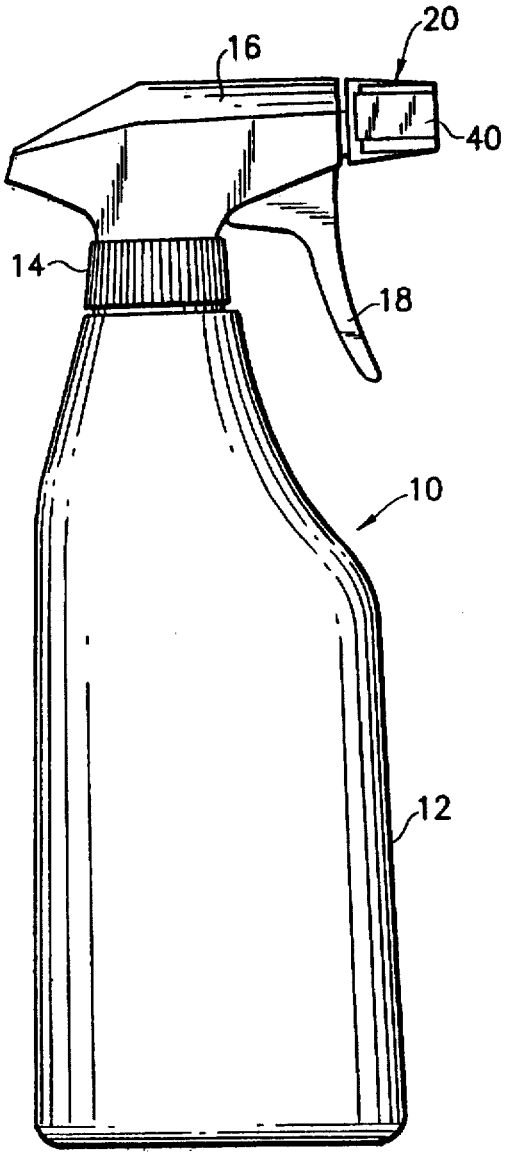
FIG. 1 a side elevational view of a pump dispenser embodying the invention.

A pump dispenser embodying the invention is shown in FIG. 1 and generally designated 10. It comprises a screw top container 12 having held thereon by an apertured screw cap 14 a pump 16. The pump has a trigger-type actuator 18 and a nozzle 20, all generally conventional.

The nozzle 20, more specifically, comprises a body 22 which may be unitarily formed with the lower half of the pump 16. The body comprises a tubular section 24 having an enlarged cylindrical head 26. The pump means including the downstream check valve is not shown and is not part of this invention. The forward part of the head 26 is formed with a pair of opposed generally U-shaped bosses 28 and 30 (FIG. 2) straddling the central opening and spaced from each other by passages 31. The upper boss is formed with inward feed channels 32 from the opposite sides of the boss 28. Liquid thus flows from the central opening of the head 26 through passages 31 to the sides of the bosses, into the channels 32 and tangentially into a swirl chamber 34 which serves as a mechanical breakup MBU. Equally offset from the axis of the opening of the head is the outward nib or detent 36 on boss 30.

The Lap 40 completes the assembly. The cap 40 may be formed with a number of flat peripheral surfaces to make the cap easy to rotate with the fingers. It will be noted from FIG. 5 that internally the cap 40 is formed with an annular inward wall 42 having an inward annular retainer 44 presenting a forward-facing shoulder 46. When the cap is pushed on in assembly, the head 26 snaps past the lead-in and inward rib 44 and the rear edge of the head 26 engages the shoulder 46 to rotatably connect the cap and body 22. The cap 40 is formed also with an inner hub 48 peripherally reduced at 49 to permit communication of the product to the spaces 31 between the bosses 28 and 30.

Figure 5:
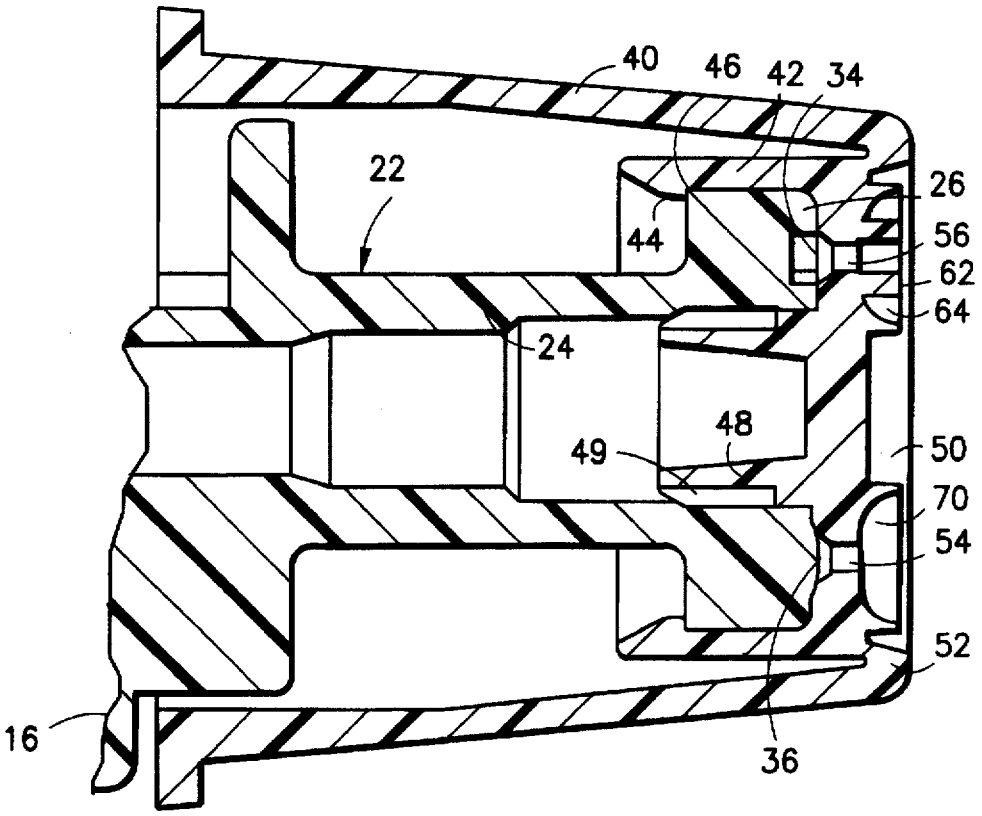
FIG. 5 is a fragmentary vertical sectional view on the axis of the nozzle.
Figure 6:
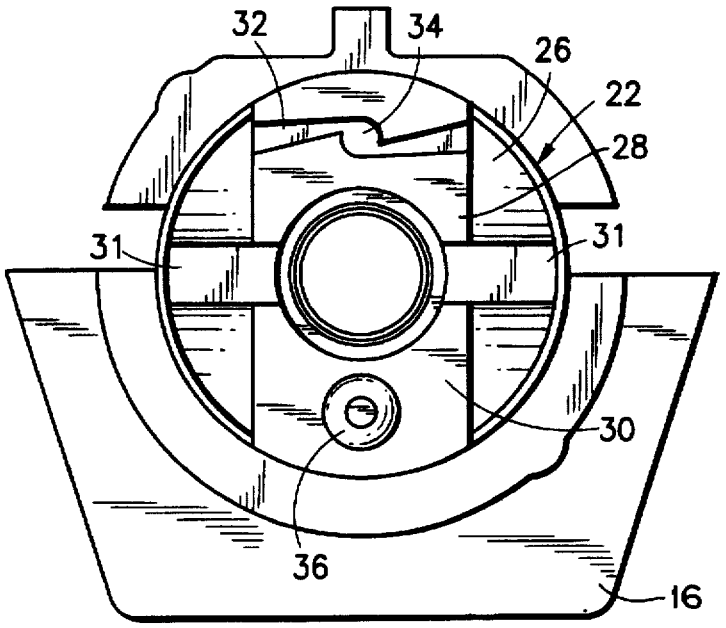
FIG. 6 is a front view of the nozzle body with the cap removed.

The front wall of the cap 40 is formed with a circular frontal recess 50 thus presenting a peripheral rib 52 (FIG. 5)

which guards the structure in the recess. The end wall is also formed with diametrically opposite orifices, namely, the conical spray orifice 54 and the fan spray orifice 56 (FIG. 4), each having a chamfered entrance. By being diametrically opposed, one of the orifices 54 or 56 is aligned with the swirl chamber 34. The other has its chamfer squarely receiving and centered on the detent 36 to hold the cap in proper radial orientation on the head 26. It should be noted that the front surface of the bosses 28 and 30 ride sealingly against the inner surface of the front wall of the cap 40.

FAN SPRAY ORIFICE STRUCTURE

Figure 3:
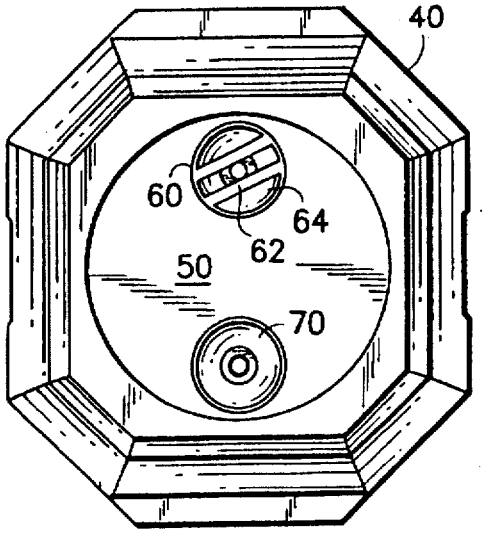
FIG. 3 is a front view of the nozzle with the fan spray in operative position.
Figure 4:
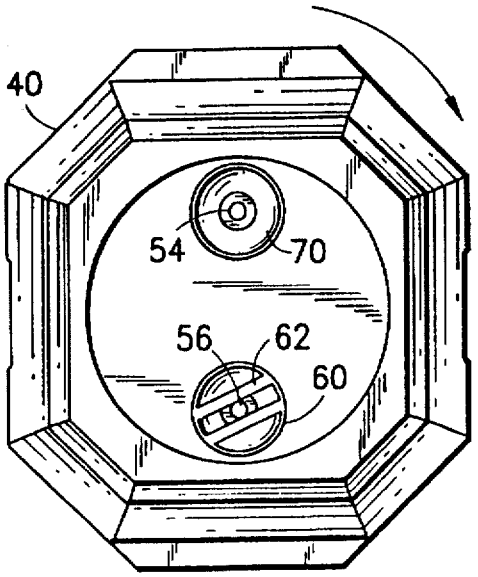
FIG. 4 is a view similar to FIG. 3 with the conical spray in operative position.
Figure 2:
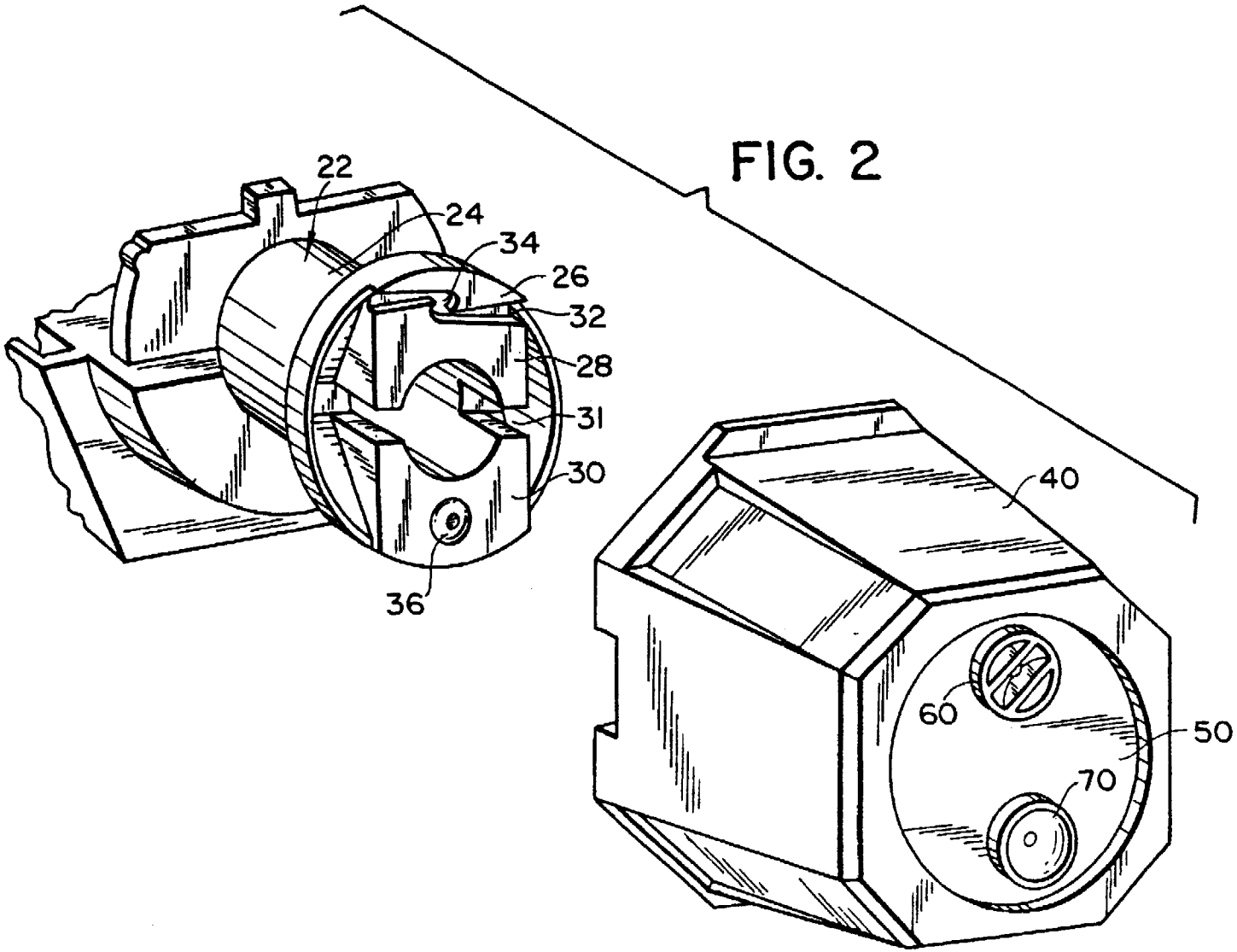
FIG. 2 is a greatly enlarged perspective exploded view of the nozzle body and cap of the dispenser of FIG. 1.

The fan spray orifice structure 60 is shown in FIGS. 2, 3 and 4 aligned with the swirl chamber; that is, at the upper portion of the nozzle. The structure essentially comprises a pair of parallel ribs 62 which are diagonally disposed and stationed on opposite sides of the orifice. Preferably, these ribs 62 may be formed in a cup-shaped structure 64 surrounding the orifice. Such a cup will protect the ribs 62. With these parallel ribs being disposed at the proper angle and extending out the proper distance from the orifice 56, the spray which would normally be emitted from the orifice is impacted or masked in a way so that the landing pattern for spray is in the form of a narrow elongate oval 0 (FIG. 8*a*). With the dispenser disposed vertically (FIG. 8*a*), it should be noted that while the bars 62 are diagonal, the resulting oval landing pattern on a vertical sheet is substantially horizontal (i.e., has a horizontal major axis). This is due to the fact that the emerging swirl is spinning and by the time it impacts the ribs and reaches its landing surface, it has been turned so that the oval is horizontal.

The angle of the bars with respect to the horizontal has been empirically determined to be in the range of 15° to 35° when the bars extend 0.035 of an inch out from the end of the orifice 34 and are tangent to the orifice. More preferably, the angle is 25°.

The bars may take other forms. They may be rounded. They may be disposed on a flush surface with the end of the orifice rather than in the cup 64 as shown.

ANTI-DRIP DISCHARGE ORIFICE

Shown in FIG. 4 aligned with the swirl chamber 34 is the anti-drip discharge 70. This discharge is a spray in the form of a cone having circular landing pattern C (FIG. 7*a*). The orifice structure is in the form of a generally hemispherical cup somewhat flattened adjacent the orifice 54. The axis of the cup is coincident with the axis of the orifice and is of a dimension giving it the capacity of approximately one drop of the liquid product. By virtue of this structure, after the conclusion of discharge, the surface tension of the liquid itself causes a residue amount of liquid exiting the orifice 54 to cling to the cup-like surface of the recess so that it is retained in the recess and may be subsequently drawn back into the nozzle during the post-operative suck back of the pump if there is such suck back.

The value of the anti-drip structure will be apparent to those who use such a dispenser for dispensing bleach, even a drop of which can ruin a dress; or an oily product which could soil fabric.

Preferably, in the preferred version the cup-shaped structure 70 is formed with a widest diameter of 0.125 inch and a curving depth of 0.035", generally hemispherical but slightly flattened as shown.

FURTHER MODIFICATIONS

Figure 7:
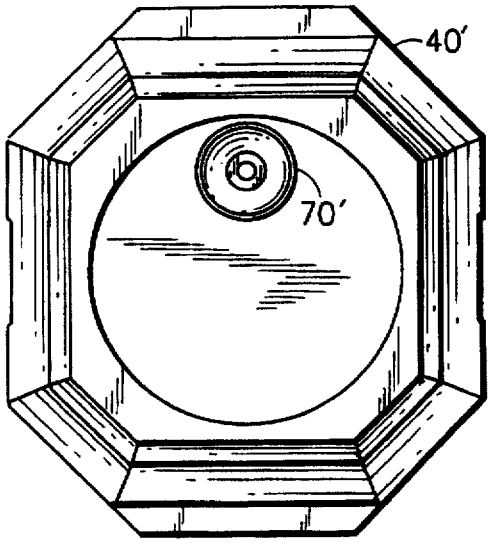
FIG. 7 is a front view of the nozzle modified to present only the conical spray orifice.
Figure 8:
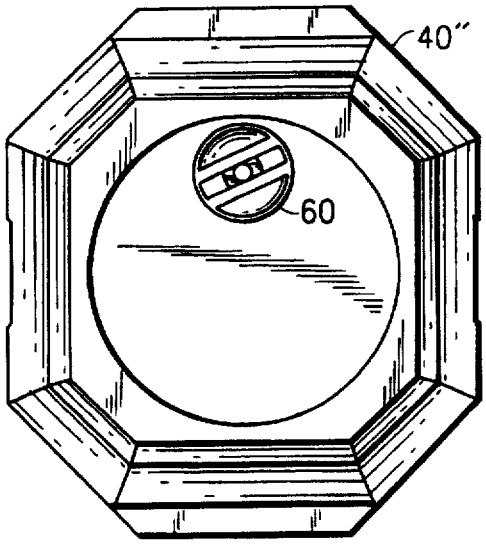
FIG. 8 is a front view of the nozzle modified to present only the fan spray orifice.
Figure 7A:
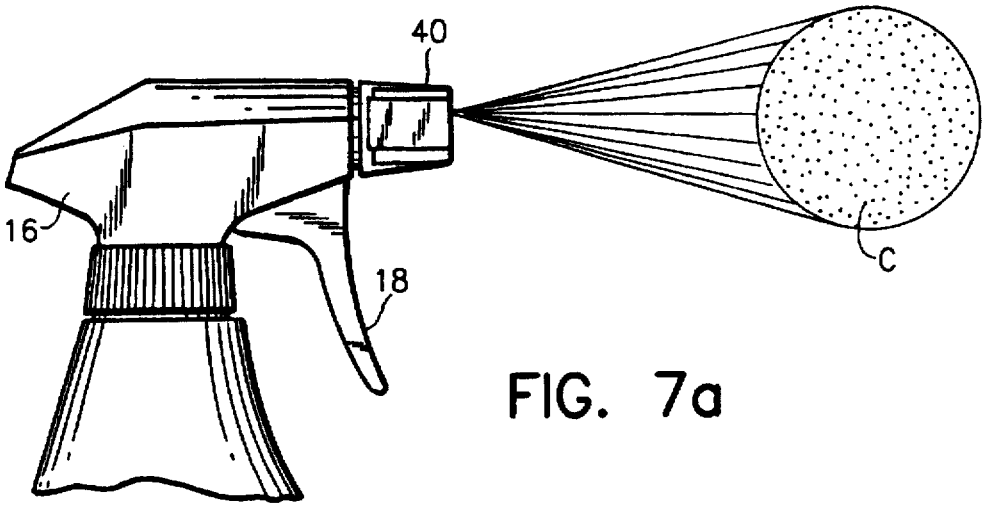
FIG. 7*a* is a fragmentary side view of the dispenser having the orifice of FIG. 7 and showing the spray and landing pattern, the latter as viewed from a point perpendicular to the landing surface.
Figure 8A:
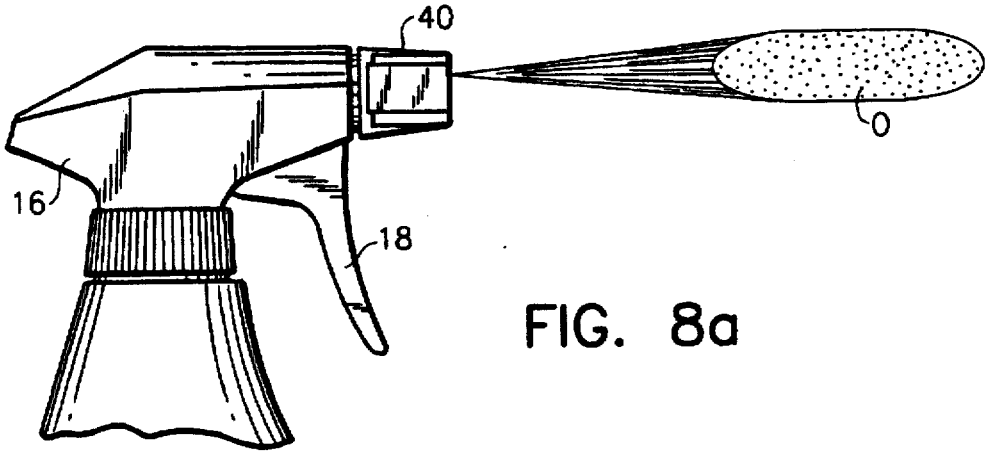
FIG. 8*a* is a fragmentary side view of the dispenser using the orifice of FIG. 8 and showing the spray and landing pattern, the latter as viewed from a point perpendicular to the landing surface.

FIGS. 7 and 8 are front views of modifications of the nozzle cap in which only a single one of the structures 60, 70 are shown so that the caps 40' and 40" respectively do not selectively provide both the forms of sprays described above. The FIG. 7 version provides a cone type spray having a landing pattern shown in FIG. 7*a* while the FIG. 8 version provides a fan spray. This is assuming that the head 26 inside the cap 40' or 40" has the structure shown in FIGS. 2 and 5.

Figure 9:
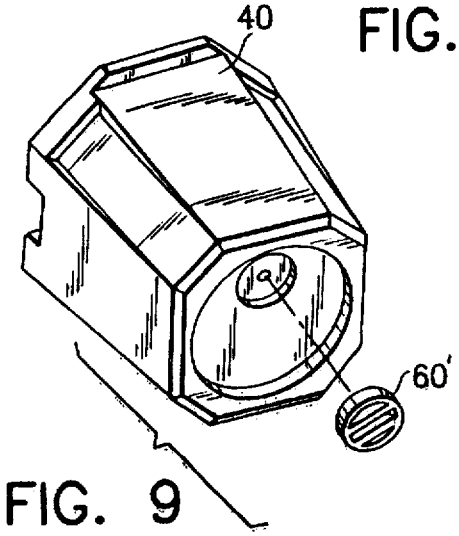
FIG. 9 is a perspective view showing that the orifice may be formed in a separate part from the cap.

FIG. 9 is of interest for its showing of a cap 40 in which the orifice structure 60' is in the form of an insert which fits into a recess 80 in the cap. This demonstrates that the cap 40 of FIG. 9 may receive any of various inserts 60' to achieve the discharge spray pattern desired. It should be understood in this connection that other orifice shapes are available, for instance, the conical spray discharge orifice may be surrounded by a foaming sleeve, as is well known in the art, to provide a foam-type product.

Thus, it is clear that the invention described here may take a number of forms. It is not so limited but is of a scope defined by the following claim language which may be broadened by an extension of the right to exclude others from making, using or selling the invention as is appropriate under the doctrine of equivalents.

What is claimed is:

1. A trigger-sprayer-type dispenser comprising:
   a. a container
   b. a manually operated pump having an inlet and an outlet, the pump being mounted on the container and connected to the container,
   c. a discharge nozzle connected to the outlet of the pump, the nozzle comprising:
      1) a tubular body having an axial bore and a planar radial end face, said planar radial end face having offset from the center thereof a forwardly facing swirl chamber cavity in liquid passage communication with said bore;
      2) a cap disposed rotatably on the end of the tubular body for rotation about an axis perpendicular to said face and spaced from the cavity, the cap having
         a. an end wall with a planar inside surface engaging the radial end face of the tubular member, the end wall having offset from the axis at least two orifices adapted when the end wall is rotated On the member about the axis to selectively register witch the center of the swirl chamber cavity to produce a spray discharge, at least one of the orifices having means to modify the spray discharge emanating from the orifice,
         b. an annular skirt projecting rearward from the periphery of said inside surface and snugly surrounding the body;
      3) mounting means carried by said body and said cap for achieving rotatable mounting of said cap on said tubular member.

2. A trigger-sprayer-type dispenser as claimed in claim 1 wherein the said one of the orifices is formed with a pair of parallel surfaces closely spaced on the opposite sides of the outside of the orifice respectively, the surfaces being disposed inclined to an imaginary horizontal line drawn through the center of the orifice whereby the spray is emitted from the dispenser in the form of a substantially flat fan-like spray pattern.

3. A trigger-sprayer-type dispenser as claimed in claim 2 wherein the major axis of the flat pattern after landing on a vertical sheet is substantially horizontal resulting from the inclination of the surfaces impacting on the spinning spray emitted from the orifice.

4. A trigger-sprayer-type dispenser as claimed in claim 3 wherein the two surfaces are in the form of bridges molded unitarily with the nozzle cap.

5. A nozzle for the dispensing of liquids, said nozzle comprising:

a. a tubular member having an axial bore and a planar radial end face, said planar radial end face having offset from the center thereof a forwardly facing swirl chamber cavity in liquid passage communication with said bore;

b. a cap disposed rotatably on the end of the tubular member for rotation about an axis perpendicular to said face and spaced from the cavity, the cap having an end wall with a planar inside surface engaging the radial end face of the tubular member, the end wall having offset from the axis at least two orifices adapted when the end wall is rotated on the member about the axis to selectively register with the center of the swirl chamber cavity to produce spray discharge, one of the orifices having means to modify the spray discharge emanating from the orifice.

6. A nozzle as claimed in claim 5 wherein the radial end face of the tubular member is formed diametrically opposite said swirl chamber with a raised detent to assist in the registering of an orifice with the swirl chamber.

7. A nozzle as claimed in claim 5 wherein one of the orifices is formed externally with a surrounding cup to eliminate post-operation dribble.

8. A nozzle as claimed in claim 5 wherein one of the orifices is formed externally with a pair of parallel diagonal bars to reshape the spray discharge to land in a thin elongate pattern.

* * * * *